US008380101B2

(12) United States Patent
Kakitani

(10) Patent No.: US 8,380,101 B2
(45) Date of Patent: Feb. 19, 2013

(54) PHOTOSENSITIVE MEMBER UNIT WITH CONTACT PORTIONS SELECTIVELY CONNECTABLE TO VOLTAGE SUPPLYING MECHANISM, AND IMAGE FORMING APPARATUS INCLUDING PHOTOSENSITIVE MEMBER UNIT

(75) Inventor: Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 470 days.

(21) Appl. No.: 12/716,529

(22) Filed: Mar. 3, 2010

(65) Prior Publication Data

US 2010/0232825 A1 Sep. 16, 2010

(30) Foreign Application Priority Data

Mar. 11, 2009 (JP) ..... 2009-057542

(51) Int. Cl.
*G03G 15/00* (2006.01)

(52) U.S. Cl. ..... 399/96

(58) Field of Classification Search ..... 399/90, 399/96, 111

See application file for complete search history.

(56) References Cited

U.S. PATENT DOCUMENTS 5,450,167 A 9/1995 Okano et al. ..... 355/210
2010/0111556 A1* 5/2010 Shibuya et al.

FOREIGN PATENT DOCUMENTS

JP 06-250575 9/1994

* cited by examiner

*Primary Examiner* — Susan Lee
(74) *Attorney, Agent, or Firm* — Fitzpatrick, Cella, Harper & Scinto

(57) ABSTRACT

A photosensitive member unit detachably mountable to each of a plurality of image forming apparatuses including a voltage supplying mechanism adapted to different commercial power sources. The photosensitive member unit includes a photosensitive member on which an electrostatic image is to be formed; a resistor configured and positioned to generate heat so as to heat said photosensitive member by energization; and a plurality of contact portions, configured and positioned to be selectively connectable to the voltage supplying mechanism, including a first contact portion and a second contact portion which are connected to both ends of said resistor and including a third contact portion connected so as to divide the resistor into two branches. At least one of the contact portions used for supplying a voltage to the resistor is common to different commercial power source voltages.

8 Claims, 5 Drawing Sheets

(a)200V SYSTEM (b)100V SYSTEM

PHOTOSENSITIVE MEMBER UNIT WITH CONTACT PORTIONS SELECTIVELY CONNECTABLE TO VOLTAGE SUPPLYING MECHANISM, AND IMAGE FORMING APPARATUS INCLUDING PHOTOSENSITIVE MEMBER UNIT

FIELD OF THE INVENTION AND RELATED ART

The present invention relates to a photosensitive member unit detachably mountable to each of a plurality of image forming apparatuses including a voltage supplying mechanism adapted to different commercial power sources and relates to an image forming apparatus to which the photosensitive member unit is detachably mountable.

The image forming apparatus may include electrophotographic machines such as a copying machine, a printer, a facsimile machine, a multi-function machine having a plurality of functions of these machines, and the like.

In the image forming apparatus, in order to prevent an abnormal image caused due to the influence of water content deposition on a photosensitive drum surface, it has been known that a heater (resistor) which generates heat by energization was provided in the photosensitive drum. The heater frequently uses a commercial power source so as to permit energization even when the power of the image forming apparatus is turned off. The heater is supplied with a commercial power source voltage. At this time, in order to obtain a necessary electric energy consumption (wattage), it can be considered that a resistance, a length, a wire diameter, and the like of a material for the heater are changed so as to adjust the resistance of the heater.

For example, when a photosensitive drum containing the heater is used for image forming apparatuses different in power source voltage, such a constitution that the photosensitive drum adapted to the power source voltage is used and a main assembly-side contact portion is changed depending on the power source voltage has been conventionally employed. In such a constitution, in order to prevent an erroneous mounting of a 100 V-specification photosensitive drum in a 200 V-specification image forming apparatus by a user, interchange preventing mechanisms are provided to the photosensitive drum and the image forming apparatus to prevent the erroneous mounting resulting from usability (Japanese Laid-Open Patent Application (JP-A) Hei 6-250575).

Further, in the case of an image forming apparatus in which power sources different in voltage for destinations, such a constitution that a heater prepared by forming on an insulating substrate four elongated heat generating elements extending in a longitudinal direction has been known (JP-A Hei 7-142148). Specifically, by the heater, whether only one of the four heat generating elements is used or the four heat generating elements are connected in series (or in parallel) is switched so that the same electric energy consumption (wattage) is provided even at any of the power source voltages.

However, in the above-described conventional constitutions, in order to adapt the photosensitive drum to the different commercial power source voltages, the photosensitive drum having a contact point arrangement adapted to the respective power source voltages is required every power source voltage. Therefore, there is need to manufacture a plurality of photosensitive drums adapted to the respective power source voltages, so that an increase in manufacturing cost is caused to occur and part management is complicated.

Further, in order to adapt a single photosensitive drum to power source voltages for different destinations (e.g., 100 V power source in Japan and 200 V power source in Europe), there is need to provide a plurality of heaters adapted to the respective power source voltages. For this reason, the single photosensitive drum is required to be provided with the plurality of heaters each having an electric contact, so that the resultant image forming apparatus is accompanied with problems that the cost is increased and a space for mounting the heaters has to be ensured.

SUMMARY OF THE INVENTION

A principal object of the present invention is to provide an inexpensive photosensitive member unit capable of adapted even a single photosensitive member to different commercial power source voltages.

Another object of the present invention is to provide an image forming apparatus to which the photosensitive member unit is detachably mountable.

According to an aspect of the present invention, there is provided a photosensitive member unit detachably mountable to each of a plurality of image forming apparatuses including a voltage supplying mechanism adapted to different commercial power sources, the photosensitive member unit comprising:

a photosensitive member on which an electrostatic image is to be formed;

a resistor configured and positioned to generate heat so as to heat the photosensitive member by energization; and a plurality of contact portions, configured and positioned to be selectively connectable to the voltage supplying mechanism, including a first contact portion and a second contact portion which are connected to both ends of the resistor and including a third contact portion connected so as to divide the resistor into two branches;

wherein at least one of the contact portions used for supplying a voltage to the resistor is common to different commercial power source voltages.

According to another aspect of the present invention, there is provided a photosensitive member unit detachably mountable to each of a plurality of image forming apparatuses including a voltage supplying mechanism which includes a first voltage supplying portion, a second voltage supplying portion and a third voltage supplying portion for supplying mutually different commercial power source voltages, the photosensitive member unit comprising:

a photosensitive member on which an electrostatic image is to be formed;

a resistor configured and positioned to generate heat so as to heat the photosensitive member by energization; and a plurality of contact portions, configured and positioned to be selectively connectable to the voltage supplying mechanism, including a first contact portion and a second contact portion which are connected to both ends of the resistor and including a third contact portion connected so as to divide the resistor into two branches;

wherein when a first voltage is supplied from the voltage supplying mechanism, the first contact portion and the second contact portion are configured and positioned to be connected to the first voltage supplying portion and the second voltage supplying portion, respectively, and wherein when a second voltage different from the first voltage is supplied from the voltage supplying mechanism, the third contact portion and at least one of the first contact portion and the second contact portion which are used for supplying the first voltage are configured and positioned to be connected to the third voltage supplying portion and at least one of the first voltage supplying portion and the second voltage supplying portion so that electric energy consumption of the resistor is equal to that at the time when the first voltage is supplied.

According to a further aspect of the present invention, there is provided an image forming apparatus, comprising:

a photosensitive member unit comprising: a photosensitive member on which an electrostatic image is to be formed; a resistor configured and positioned to generate heat so as to heat the photosensitive member by energization; and a plurality of contact portions, configured and positioned to be selectively connectable to the voltage supplying mechanism, including a first contact portion and a second contact portion which are connected to both ends of the resistor and including a third contact portion connected so as to divide the resistor into two branches; and a voltage supplying mechanism configured and positioned to be selectively connectable to the plurality of contact portions and to be adapted to different commercial power source voltages, wherein when a first commercial power source voltage is input into the voltage supplying mechanism, the voltage supplying mechanism is configured and positioned to be connected to the first contact portion and the second contact portion, and wherein when a second commercial power source voltage different from the first commercial power source voltage is input into the voltage supplying mechanism, the voltage supplying mechanism is configured and positioned to be connected to the third contact portion and at leas tone of the first contact portion and the second contact portion so that electric energy consumption of the resistor is substantially equal to that at the time when the first commercial power source voltage is input.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, with reference to the drawings, embodiments of the present invention will be described. However, dimensions, materials, shapes, and relative arrangements, and the like of constituent elements described in the following embodiments may be appropriately be changed depending on constitutions and various conditions for apparatuses or units to which the present invention is applied. Therefore, it should be understood that the present invention is not limited to those specifically described in the following embodiments unless otherwise noted specifically.

Figure 2:
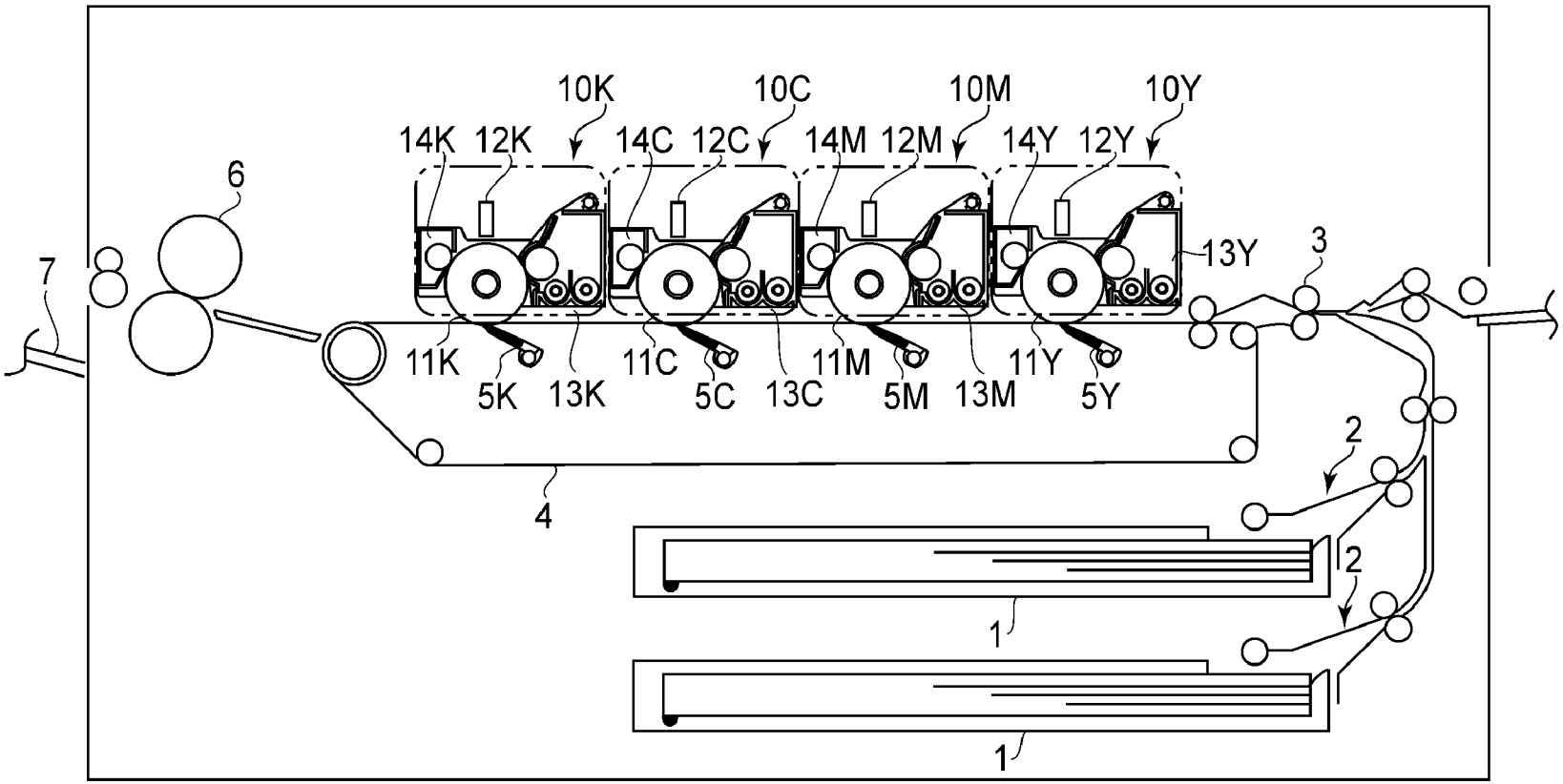
FIG. 2 is a sectional view of an image forming apparatus.
Figure 3:
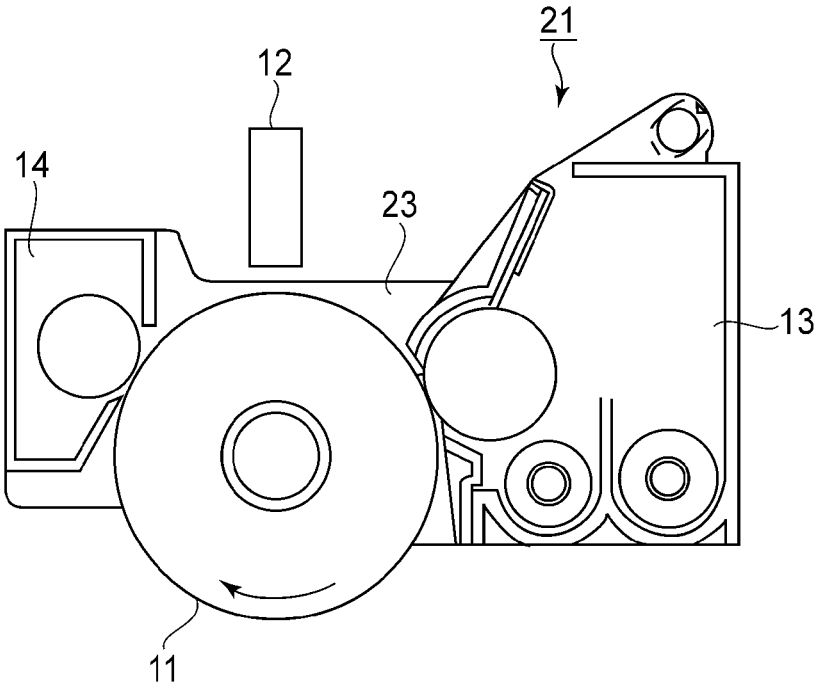
FIG. 3 is a sectional view of an image forming portion in the image forming apparatus.

First, with reference to FIGS. 2 and 3, a general structure of an image forming apparatus of an electrophotographic type in which a photosensitive member unit is provided detachably mountably will be described. FIG. 2 is a sectional view of the image forming apparatus. FIG. 3 is a sectional view of an image forming portion in the image forming apparatus. In this embodiment, a system including a photosensitive member unit and a voltage supplying mechanism described later for supplying a voltage to the photosensitive member unit so as to heat a photosensitive member is referred to as a photosensitive member heating system.

(General Structure of Image Forming Apparatus)

As shown in FIG. 2, the image forming apparatus forms a full-color image by superposing tones of four colors of yellow, magenta, cyan, and black.

In FIG. 2, 10Y, 10M, 10C and 10K represent image forming portions for yellow, magenta, cyan and black, respectively. FIG. 3 is an enlarged view of one (single) image forming portion (station). The respective image forming portions have the same constitution except that the colors of the toners are different from each other.

A recording material (medium) such as recording paper or the like accommodated in a cassette 1 is fed by a sheet feeding portion 2 to reach registration rollers 3 by which oblique movement or the like of the recording material is corrected and then the recording material is fed toward a transfer belt 4 with appropriate timing by the registration rollers 3. During the feeding, in accordance with an image information signal sent from an original reading device (not shown) or an output device of a computer (not shown), a latent image for each of the colors is formed on associated one of photosensitive drums 11Y, 11M, 11C and 11K.

On the other hand, the recording material sent from the registration rollers 3 is electrostatically attracted on the transfer belt 4 and is conveyed while passing under the respective image forming portions 10Y, 10M, 10C and 10K. At the image forming portions 10Y, 10M, 10C and 10K, the photosensitive drums 11Y, 11M, 11C and 11K on each surface of which an electrostatic (latent) image is to be formed are provided, respectively. Around the respective photosensitive drums 11Y, 11M, 11C and 11D, exposure LED heads 12Y, 12M, 12C and 12K, developing devices 13Y, 13M, 13C and 13K, and injection chargers 14Y, 14M, 14C and 14K are disposed. By an electrophotographic process, toner images of the respective colors are formed on the surfaces of the respective photosensitive drums 11Y, 11M, 11C and 11K. Then, the respective color toner images are successively transferred onto the recording material at transfer portions, where the transfer belt 4 is brought near to the photosensitive drums 11Y, 11M, 11C and 11K, by the action of transfer means 5Y, 5M, 5C and 5K.

The recording material onto which the four color toner images are transferred is separated by curvature from the transfer belt 4 and is sent to a fixing portion 6 in which the toner images are fixed under heat and pressure. Thereafter, the recording material is discharged on a sheet discharge tray 7 to complete a copying operation.

In the above-described image forming apparatus, a commercial power source voltage such as 100 V or 200 V varies depending on regions in which the image forming apparatus is used by users (from a world-wide viewpoint). Therefore, in the image forming apparatus in this embodiment, a voltage supplying mechanism for supplying a voltage to a heater mounted to a hollow portion of each photosensitive member is provided correspondingly to image forming apparatuses having the substantially same basic constitution and function (such as an image forming speed or the like) but having the different commercial power source voltages.

In other words, a process cartridge (photosensitive member unit) described later is configured and positioned to be used in common with a plurality of image forming apparatuses pertaining to a group of image forming apparatuses having the substantially same basic constitution and function. That is, the process cartridge (photosensitive member unit) has a constitution such that it can be mounted to each of the plurality of image forming apparatuses pertaining to the image forming apparatus group without being limited. This is because, as described later, when process cartridges which are changed in structure of electric contacts for each of regions different in commercial power source voltage are prepared, an increase in cost of the process cartridge is caused to occur.

However, in order to obviate inconveniences caused by the different colors of the toners used, each of the process cartridges (photosensitive member units) is restricted so that it can only be mounted in a mounting portion which has been set in advance in the image forming apparatus. That is, each of the process cartridges is provided with a conventionally known interchange preventing mechanism with respect to the color so that, e.g., the process cartridge for the yellow toner can only be mounted in the mounting portion, for the yellow toner, in the image forming apparatus.

(Constitution of Process Cartridge)

Figure 4:
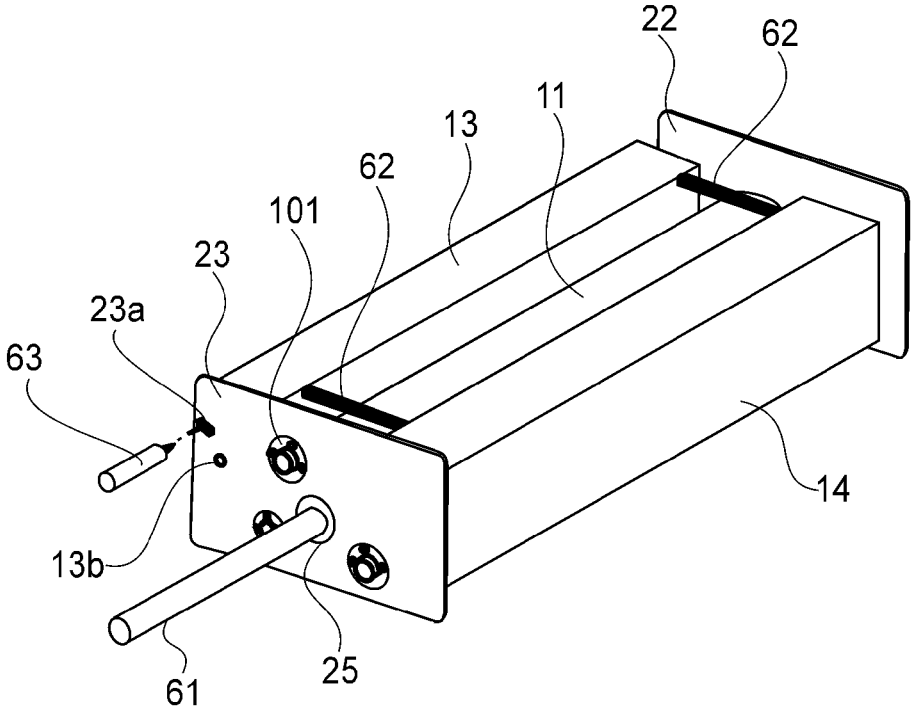
FIG. 4 is a perspective view of a process cartridge.
Figure 5:
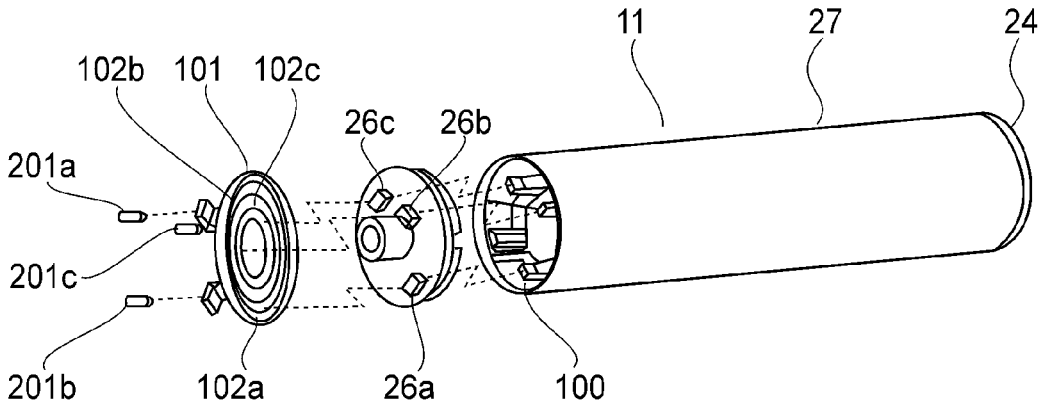
FIG. 5 is a perspective view of development of a drum unit in the process cartridge.

Next, with reference to FIGS. 4 and 5, a process cartridge 21 will be described. FIG. 4 is a perspective view of the process cartridge and FIG. 5 is a perspective view of development of a drum unit in the process cartridge. The process cartridge 21 is provided at each of the image forming portions and is detachably mounted to an apparatus main assembly.

As shown in FIG. 4, the process cartridge (photosensitive member unit) 21 is constituted by the photosensitive drum 11 and process means, acting on the photosensitive drum 11, consisting of the developing device (developing means) 13 and the injection charger (charging means) 14. The photosensitive drum 11, the developing device 13 and the injection charger 14 are, as shown in FIG. 4, integrally supported by kit side plates 22 and 23.

Figure 6:
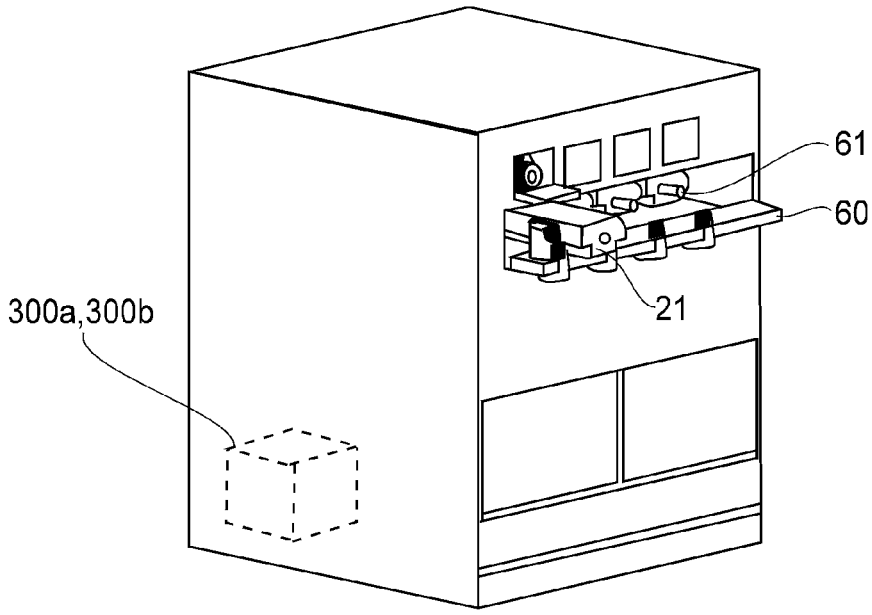
FIG. 6 is a perspective view of the image forming apparatus.

Further, as shown in FIGS. 4 and 6, at a front surface of the image forming apparatus, an openable front door for rotatably supporting a drum shaft 61. The drum shaft 61 is provided, in the apparatus main assembly, for driving the photosensitive drum 11. The front door 60 is closed during image formation. During exchange of the process cartridge 21, by opening the front door 60 as shown in FIG. 6, the process cartridge 21 is detachably mountable with respect to a longitudinal direction thereof. As a result, the components of the process cartridge 21 can be easily exchanged and maintained as a unit.

Next, a supporting method of the process cartridge 21 will be described with reference to FIGS. 4 and 5.

The photosensitive drum 11 is, as shown in FIGS. 4 and 5, supported by rotatably engaging flange portions 24 and 25 thereof with the kit side plates 22 and 23. Further, the injection charger 14 is fixed to the kit side plates 22 and 23 by positioning portions provided at its side surfaces. As shown in FIG. 4, the developing device 13 is swingably supported by the kit side plates 22 and 23 through a swinging supporting point 13*b*. By urging springs 62 provided between the developing device 13 and the injection charger, abutting members (not shown) provided to both end portions of a developing sleeve 13*a* abut against the photosensitive drum 11. As a result, a gap between the developing sleeve 13*a* and the photosensitive drum 11 kept at a predetermined level. When the process cartridge 21 is mounted in the apparatus main assembly, the flange portions 24 and 25 rotatably supported by the kit side plates 22 and 23 are engaged with the drum shaft 61. Further, a pin 63 provided to a side plate of the apparatus main assembly is engaged in an elongated round hole 23*a* provided in the kit side plate 23. Then, the drum shaft 61 is rotatably held at its one end by the front door 60, so that the photosensitive drum 11 and the process cartridge 21 are positioned to the apparatus main assembly.

Next, the photosensitive drum 11 will be described with reference to FIG. 5. The photosensitive drums at the respective image forming portions are similarly constituted. Thus, they will be described as the photosensitive drum 11.

(Heater and Electric Contact Portion)

The Photosensitive Drum 11 is Constituted by a drum bare tube portion 27 and the flange portions 24 and 25. Inside the photosensitive drum 11, a heater 100 for warming the drum bare tube portion 27 is provided. The heater 100 is a resistor which generates heat, by energization, for heating the photosensitive drum 11. By this heater 100, the water content deposited on the surface of the drum bare tube portion 27 can be vaporized to prevent an abnormal image.

The heater 100 is a sheet-like heat generating member in which heating wires are stretched around. The heater 100 is bonded to an inner surface of the drum bare tube portion 27, so that the heat of the heater 100 is directly conducted to the drum bare tube portion 27.

Figure 1:
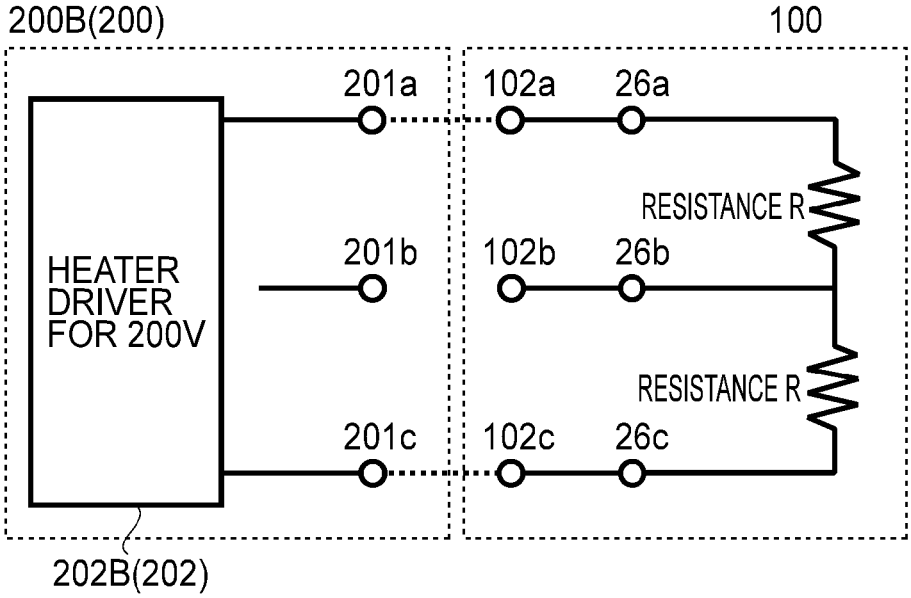
FIGS. 1(*a*) and 1(*b*) are circuit diagrams each schematically showing a constitution of a heater, wherein FIG. 1(*a*) is a circuit diagram of a 200 V system and FIG. 1(*b*) is a circuit diagram of a 100 V system.
Figure 1:
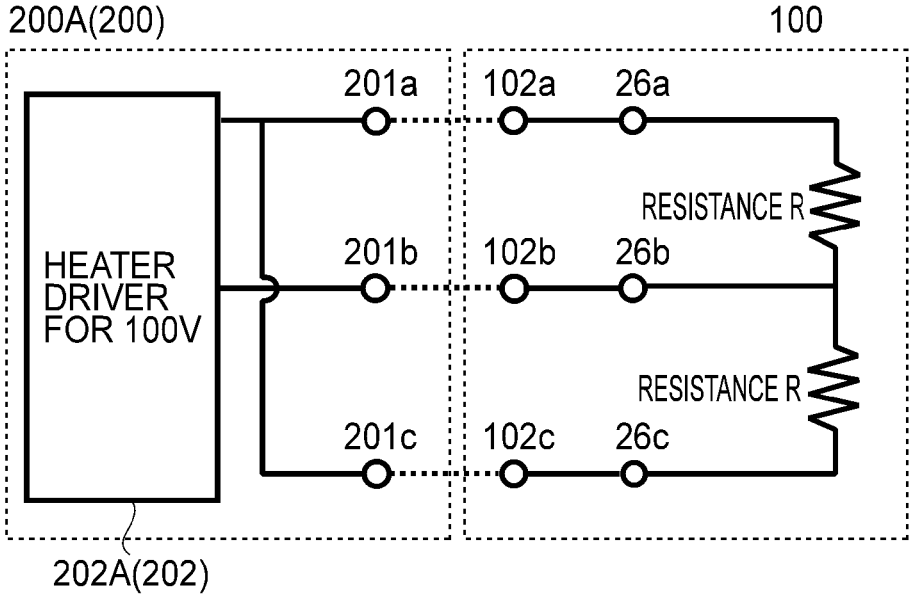

Further, from the heater 100, three bundle wires are extended and connected to a plurality of heater contact portions 26*a*, 26*b* and 26*c* provided on the flange 25. These heater contact portions 26*a*, 26*b* and 26*c* are, as shown in FIGS. 1(*a*) and 1(*b*), selectively connectable to a voltage supplying mechanism 200 on the apparatus main assembly side. Of the plurality of heater contact portions, the heater contact portions 26*a* and 26*c* are first and second contact portions connected to both ends of the heater (heating wire) 100. Further, the heater contact portion 26*b* is a third contact portion connected so as to divide the heater (heating wire) 100 into two branches.

Of the contact portions connected to the heater 100, the heater contact portion 26*b* dividing the heater 100 into two branches is connected, when a second voltage is supplied, together with the heater contact portions 26*a* and 26*c* used for supplying a first voltage as shown in FIG. 1(*b*). At this time, the heater contact portions 26*a*, 26*b* and 26*c* are connected so that the electric energy consumption of the heater is equal to that at the time when the first voltage is supplied.

Further, as shown in FIGS. 4 and 5, to the kit side plate 25, a slip ring 101 is provided. To the slip ring 101, a plurality of ring-like contact portions 102*a*, 102*b* and 102*c* different in diameter is provided. Electric energy is supplied by selectively connecting three main assembly-side electrodes 201*a*, 201*b* and 201*c* provided on the apparatus main assembly side with the ring-like contact portions 102*a*, 102*b* and 102*c*, respectively, provided in the slip ring 101.

Each of the three heater contact portions 26*a*, 20*b* and 26*c* contains a spring which is provided at one longitudinal end portion of the photosensitive drum 11 so that it can be expanded and contracted in the longitudinal direction of the photosensitive drum 11. These three heater contact portions 26*a*, 26*b* and 26*c* are, as shown in FIG. 5, slidably connected to the ring-like contact portions 102*a*, 102*b* and 102*c*, respectively, provided in the slip ring 101. As a result, the heater contact portions 26*a*, 26*b* and 26*c* rotate while sliding on the ring-like contact portions 102*a*, 102*b* and 120*c* to which the main assembly-side electrodes 201*a*, 201*b* and 201*c* are selectively connected, so that the electric energy supply to the heater 100 is effected with reliability.

The ring-like contact portion 102*a* is a first ring-like contact portion to which the heater contact portion 26*a* is slidably connected. The ring-like contact portion 102*b* is a third ring-like contact portion to which the heater contact portion 26*b* is slidably connected. The ring-like contact portion 102*c* is a second ring-like contact portion to which the heater contact portion 26*c* is slidably connected.

The heater 100 is schematically illustrated in FIGS. 1(*a*) and 1(*b*) such that two resistors are connected. To the both ends of the heater 100, the heater contact portion 26*a* as the first contact portion and the heater contact portion 26*c* as the second contact portion are connected. Further, the heater contact portion 26*b* as the third contact portion is connected so as to divide the heater 100 into two branches. The heater contact portions 26*a*, 26*b* and 26*c* are, as described above, connected to the ring-like contact portions 102*a*, 102*b* and 102*c* provided in the slip ring 101.

The process cartridge-side slip ring 101 is, as described above, selectively connected with the three main assembly-side electrodes 201*a*, 201*b* and 201*c*, respectively, extended from the apparatus main assembly and are controlled by a heater driver 202 (FIGS. 1(*a*) and 1(*b*)). The main assembly-side electrodes 201*a*, 201*b* and 201*c* and the heater driver 202 constitute the voltage supplying mechanism 200. The energization from the power source to the respective main assembly-side electrodes 201*a*, 201*b* and 201*c* is controlled by the heater drivers 202A and 202B provided corresponding to different voltages.

Thus, although the heater drivers adapted to the commercial power source voltages are incorporated in the image forming apparatuses pertaining to the image forming apparatus group, the main assembly-side electrodes 201*a*, 201*b* and 201*c* themselves are provided in common with the image forming apparatuses. That is, depending on the regions in which the image forming apparatus is used, there is the main assembly-side electrode which is not used. This is because in the case where the constitution of the main assembly-side electrodes of the voltage supplying mechanism mounted in the image forming apparatus is changed every region in which the commercial power source voltage is different, the increase in cost of the image forming apparatus can be avoided.

The voltage supplying mechanism 200 is provided corresponding to the different commercial power source voltages. The commercial power source voltage is input into the voltage supplying mechanism 200 and is supplied to the heater through the contact portions selectively connected with the voltage supplying mechanism 200. In this embodiment, in FIGS. 1(*a*) and 1(*b*), as the voltage supplying mechanism 200, a first voltage supplying mechanism 200A for supplying a first commercial power source voltage of 100 V and a second voltage supplying mechanism 200B for supplying a second commercial power source voltage of 200 V different from the first commercial power source voltage are illustrated.

The first voltage supplying mechanism 200A is constituted by the heater driver 202A for 100 V and the main assembly-side electrodes 201*a* and 201*c* for supplying 100 V. In the first voltage supplying mechanism 200A, the main assembly-side electrode 201*a* is a first main assembly-side electrode connected with the heater contact portion 26*a* and the main assembly-side electrode 201*c* is a second main assembly-side electrode connected with the heater contact portion 26*c*. Incidentally, in the first voltage supplying mechanism 200A, the main assembly-side electrode 201*b* is configured and positioned so as not to function as a voltage supplying portion by the control of the heater driver.

The second voltage supplying mechanism 200B is constituted by the heater driver 202B for 200 V and the main assembly-side electrodes 201*a*, 201*b* and 201*c* for supplying 200 V. In the second voltage supplying mechanism 200B, the main assembly-side electrode 201*b* is a third main assembly-side electrode connected to the heater contact portion 26*b*. Further, in the second voltage supplying mechanism 200B, the main assembly-side electrode (first voltage supplying portion) 201*a* connected with the heater contact portion 26*a* and the main assembly-side electrode (second voltage supplying portion) 201*c* connected with the heater contact portion 26*c* are connected to each other, thus functioning as a single (one) voltage supplying portion.

Figure 7:
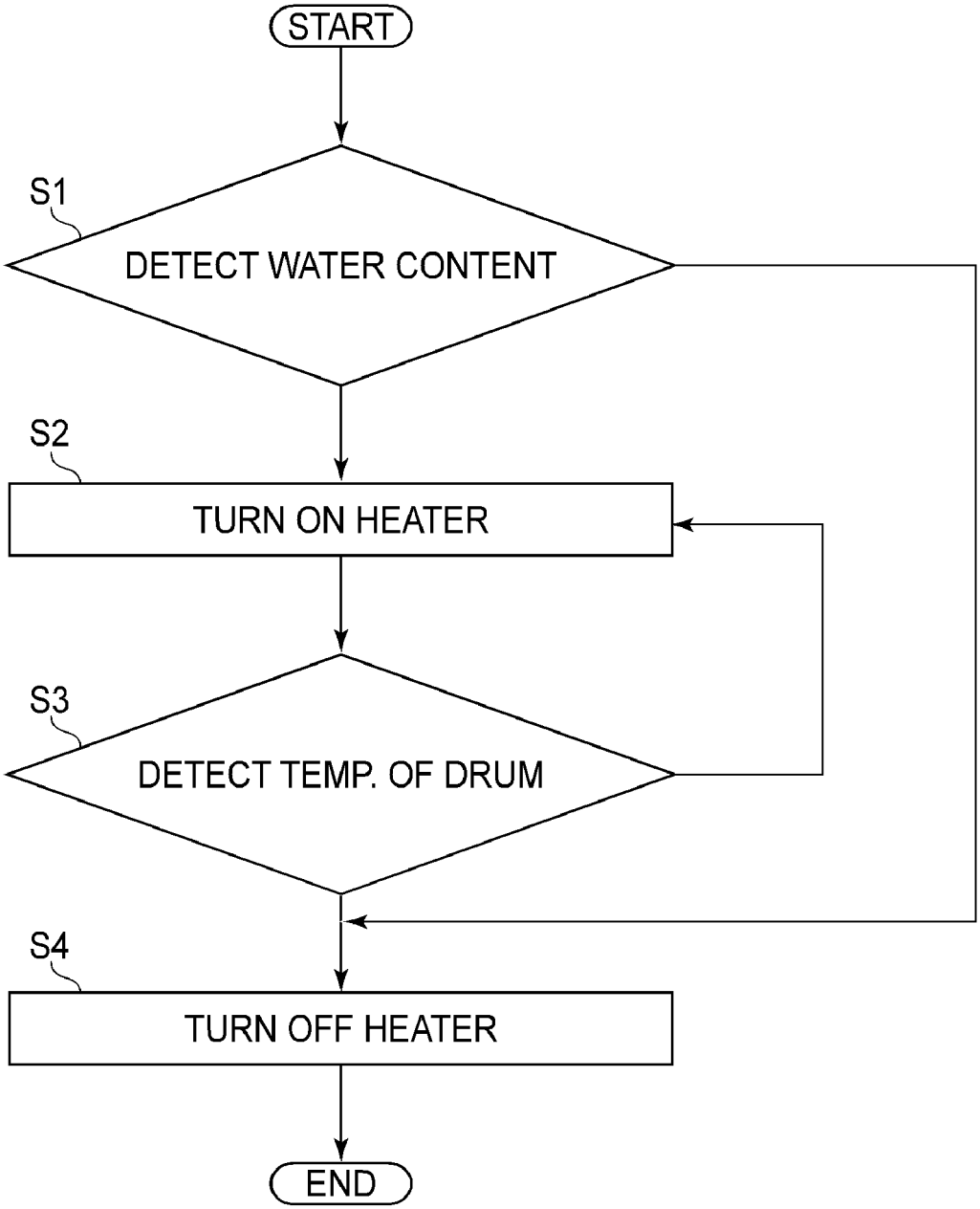
FIG. 7 is a flow chart for illustrating control of a drum heater.

The control of the heater driver will be described. As shown in FIG. 7, first, in a step S1, a temperature and a humidity at a place when the image forming apparatus is mounted is detected by an environment sensor provided to the apparatus main assembly. The water content value corresponding to the detected value is stored in the memory in the apparatus main assembly and when the water content value exceeds a certain threshold, the procedure goes to a step S2 in which the energization to the heater is turned on. At this time, in a step S3, the temperature of the drum surface is detected by the sensor provided to the surface of the photosensitive drum 11 and when the detected temperature reaches a certain temperature, the energization to the heater is turned off (step S4). The detection of the temperature of the photosensitive drum surface is always continued and when the photosensitive drum surface temperature is lower than a desired temperature (step S3), the energization to the heater is turned on (step S2). A series of these control operations is performed by the heater driver.

In the case where the power source of the destination of the image forming apparatus is a 200-volt power source, as shown in FIGS. 1(*a*) and 6, a power source unit (commercial power source) 300*a* into which the heater driver 202B for the 200-volt power source is incorporated is used. Further, the main assembly-side electrodes 201*a* and 201*c* are connected to the ring-like contact portions 102*a* and 102*c*, respectively, to form a single series circuit in which the heater 100 is connected with the electrodes and contact portions in series.

On the other hand, in the case where the power source of the destination of the image forming apparatus is a 100-volt power source, as shown in FIGS. 1(*b*) and 6, a power source unit (commercial power source) 300*b* into which the heater driver 202A for the 100-volt power source is incorporated is used. Further, the main assembly-side electrodes 201*a*, 201*b* and 201*c* are connected to the ring-like contact portions 102*a*, 102*b* and 102*c*, respectively, to form a single parallel circuit in which the heater 100 is connected with the electrodes and contact portions in parallel.

Thus, each process cartridge is configured and positioned so that the ring-like contact portions 102*a* and 102*c* (the heater contact portions 26*a* and 26*c*) of the contact portions used for supplying the voltage to the heater 100 are common to the different commercial power source voltages (100 V and 200 V in this embodiment). However, the constitution of each process cartridge is not limited to the above constitution but may only be required to configure and position at least one of the contact portions used for supplying the voltage to the heater 100 so as to be common to the different commercial power source voltages.

As shown in FIG. 6, with respect to the constitutions of the image forming apparatuses of 100 V-type and 200 V-type, the image forming apparatuses have the same constitution except that only the power source units 300*a* and 300*b* including power source connectors and the heater drives are replaced with each other. In these image forming apparatuses, as shown in FIG. 6, the respective process cartridges 21 have the same constitution except that the colors of the toners are different from each other, thus being detachably mountable to the image forming apparatuses.

Next, an amount of heat generation (electric energy consumption) of the heater in the case of the connection by which mutually different voltages are supplied will be described.

As described above, the heater 100 includes the three bundle wires, which are connected in the manner as shown in FIGS. 1(*a*) and 1(*b*). The resistor divided into two branches by the heater contact portion 26*b* (third contact portion) in the heater is regarded as two resistors each having a resistance value R. In this embodiment, the constitution in which the respective resistors (two branches) have the same resistance value R will be described as an example but the resistance value is not limited thereto.

An electric energy consumption P of the heater 100 with respect to a commercial power source voltage V to be supplied is: $P=IV=V^2/R$. That is, when the photosensitive drum 11 is mounted in the apparatus main assembly provided with the 100-volt power source, the resultant circuit is the same as the parallel circuit shown in FIG. 1(*b*). For this reason, the electric energy consumption (heat generation amount) P of the heater 100 with respect to the second voltage of 100 V is: $P=100\times100/(R/2)=20000/R$.

On the other hand, when the photosensitive drum 11 is mounted in the apparatus main assembly provided with the 200-voltage power source, the resultant circuit is the same as the series circuit shown in FIG. 1(*a*). For this reason, the electric energy consumption (heat generation amount) P of the heater 100 with respect to the first voltage of 200 V is: $P=200\times200/(2R)=20000/R$. That is, in either case of the 100-volt power source and the 200-volt power source, the electric energy consumption (heat generation amount) P of the heater 100 is equal.

Therefore, even when the single photosensitive drum 11 including the single heater 100 to which the three heater contact portions 26*a*, 26*b* and 26*c* are connected is mounted in the apparatus main assembly adapted to the different commercial power source voltages, the different commercial power source voltages can be compatibly supplied.

Further, the heater driver 202 is integrally supported as the power source unit, so that the heater drivers adapted to the respective voltages can be used. As a result, based on the above-described calculations, the heater 100 can obtain a predetermined heat generation amount (electric energy consumption) with respect to the different commercial power source voltages.

As described above, according to this embodiment, only by selectively connecting the three contact portions 26*a*, 26*b* and 26*c* with the heater, even the single photosensitive member 11 can be adapted to the different power source voltages (100 V and 200 V). Further, in this case, at least one of the three heater contact portions is common to the different power source voltages, thus leading to cost reduction. Further, the constitution in which the three heater contact portions are only connected with the heater is employed, so that the constitution is not only inexpensive but also simple. Further, the mounting space for the heater in the photosensitive drum is not required to be increased.

That is only by selectively connecting the plurality of contact portions with the resistor, even the single photosensitive member can be adapted to the different commercial power source voltages supplied from the voltage supplying mechanism. Further, in this case, at least one of the plurality of contact portions is common to the different commercial power source voltages, thus leading to cost reduction. Further, the constitution in which the plurality of contact portions are only connected with the resistor is employed, so that the constitution is not only inexpensive but also simple. Further, the mounting space for the resistor in the photosensitive member is not required to be increased.

In the above-described embodiment, as an example, the constitution in which the third contact portion dividing the heater into two branches is connected in combination with the first and second contact portions used for supplying the first voltage so that the electric energy consumption of the heater at the time when the second voltage is supplied is substantially equal to that at the time when the first voltage is supplied. The term "substantially equal" includes the case where a difference between the two values of the electric energy consumption is within an error. The constitution employed in the above-described embodiment is such that the three heater contact portions 26*a*, 26*b* and 26*c* are connected with the heater in parallel so that the electric energy consumption of the heater at the time when the second voltage (100 V) is supplied is equal to that at the time when the first voltage (200 V) is supplied. However, the present invention is not limited thereto. It is also possible to employ a constitution in which the third contact portion is connected in combination with at least one of the first and second contact portions used for supplying the first voltage so long as the electric energy consumption of the heater at the time when the second voltage is supplied is equal to that at the time when the first voltage is supplied. Specifically, such a constitution that at least one of the first contact portion (heater contact portion 26*a*) and the second contact portion (heater contact portion 26*c*) which are used for supplying the first voltage is connected in combination with the third contact portion (heater contact portion 26*b*) may be employed. In this case, the resistance values of the respective resistors of the heater divided by the third contact portion are, e.g., set at a resistance value R1 of 100Ω and a resistance value R2 of 200Ω. Then, when the voltage of 200 V is supplied, the resistors are connected to provide a resistance value of 100Ω+300Ω. When the voltage of 100 V is supplied, the resistors are connected to provide a resistance value of 100Ω. Also in this constitution, even when the different voltages are supplied, the same electric energy consumption of the heater can be achieved.

When the different voltages are supplied, if one connection is in series and the other connection is in parallel, the contact portion for connecting the resistor (heater) may also divide the resistor into two branches at a substantially longitudinal central portion of the photosensitive drum. However, the contact portion for dividing the resistor (heater) into two branches does not always divide the resistor into two branches at the substantially longitudinal central portion of the photosensitive drum as shown in FIGS. 1(*a*) and 1(*b*). For example, as described above, in the case where one resistance value R1 of 100Ω and the other resistance value R2 of 300Ω are set with respect to the two resistors branched by the contact portion, these resistors having the resistance values may be configured and positioned to be provided along the longitudinal direction of the photosensitive drum.

As a result, in either of the connections by which the different voltages are supplied, the same heat generation amount (electric energy consumption) can be obtained over the longitudinal direction of the photosensitive drum.

In the above-described embodiment, the four image forming portions are used but the number of the image forming portions is not limited thereto. The number of the image forming portions may be appropriately set as desired.

Further, in the above-described embodiment, as the photosensitive member unit detachably mountable to the image forming apparatus, the process cartridge integrally including the photosensitive drum and the process means, acting on the photosensitive drum, consisting of the charging means and the developing means is described but the photosensitive member unit is not limited thereto. For example, the photosensitive member unit may be a process cartridge (photosensitive member unit) integrally including the photosensitive drum and any one of the charging means, the developing means, and the cleaning means or may be a photosensitive member unit including the photosensitive drum alone.

Further, in the above-described embodiment, the image forming apparatus in which the recording material carrying member for carrying and conveying the recording material is used and the respective color toner images are successively transferred onto the recording material in the superposition manner is described but the present invention is not limited thereto. It is also possible to use an image forming apparatus in which an intermediary transfer member is used and the respective color toner images are successively transferred onto the intermediary transfer member in the superposition manner and then are collectively transferred onto the recording material. By applying the present invention to the photosensitive member unit, including the resistor, used in this image forming apparatus, a similar effect can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 057542/2009 filed Mar. 11, 2009, which is hereby incorporated by reference.

What is claimed is:

1. A photosensitive member unit detachably mountable to each of a plurality of image forming apparatuses including a voltage supplying mechanism adapted to different commercial power sources, said photosensitive member unit comprising:

a photosensitive member on which an electrostatic image is to be formed;

a resistor configured and positioned to generate heat so as to heat said photosensitive member by energization; and a plurality of contact portions, configured and positioned to be selectively connectable to the voltage supplying mechanism, including a first contact portion and a second contact portion which are connected to both ends of said resistor and including a third contact portion connected so as to divide said resistor into two branches;

wherein at least one of the contact portions used for supplying a voltage to said resistor is common to different commercial power source voltages.

2. A unit according to claim 1, wherein the contact portions used for supplying the voltage to said resistor are configured and positioned so that the contact portions, of said plurality of contact portions, providing the same electric energy consumption even when different voltages are supplied are selectively connected and so that at least one of the selectively connected contact portions is common to the different commercial power source voltages.

3. A unit according to claim 1, wherein when a first voltage is supplied from the voltage supplying mechanism, the first contact portion and the second contact portion are configured and positioned to be connected, and wherein when a second voltage different from the first voltage is supplied from the voltage supplying mechanism, at least one of the first contact portion and the second contact portion which are used for supplying the first voltage is configured and positioned to be connected in combination with the third contact portion so that electric energy consumption of said resistor is equal to that at the time when the first voltage is supplied.

4. A unit according to claim 1, wherein when a first voltage is supplied from the voltage supplying mechanism, the first contact portion and the second contact portion are configured and positioned to be connected with said resistor in series, and wherein when a second voltage different from the first voltage is supplied from the voltage supplying mechanism, the first contact portion, the second contact portion and the third contact portion are configured and positioned to be connected with said resistor in parallel.

5. A photosensitive member unit detachably mountable to each of a plurality of image forming apparatuses including a voltage supplying mechanism which includes a first voltage supplying portion, a second voltage supplying portion and a third voltage supplying portion for supplying mutually different commercial power source voltages, said photosensitive member unit comprising:

a photosensitive member on which an electrostatic image is to be formed;

a resistor configured and positioned to generate heat so as to heat said photosensitive member by energization; and a plurality of contact portions, configured and positioned to be selectively connectable to the voltage supplying mechanism, including a first contact portion and a second contact portion which are connected to both ends of said resistor and including a third contact portion connected so as to divide said resistor into two branches;

wherein when a first voltage is supplied from the voltage supplying mechanism, the first contact portion and the second contact portion are configured and positioned to be connected to the first voltage supplying portion and the second voltage supplying portion, respectively, and wherein when a second voltage different from the first voltage is supplied from the voltage supplying mechanism, the third contact portion and at least one of the first contact portion and the second contact portion which are used for supplying the first voltage are configured and positioned to be connected to the third voltage supplying portion and at least one of the first voltage supplying portion and the second voltage supplying portion so that electric energy consumption of said resistor is equal to that at the time when the first voltage is supplied.

6. A unit according to claim 5, wherein when the first voltage is supplied from the voltage supplying mechanism, the first contact portion and the second contact portion are configured and positioned to be connected with the first voltage supplying portion and the second voltage supplying portion so that said resistor is connected in series, and wherein when a second voltage different from the first voltage is supplied from the voltage supplying mechanism, the first contact portion, the second contact portion and the third contact portion are configured and positioned to be connected with the first voltage supplying portion, the second voltage supplying portion and the third voltage supplying portion so that said resistor is connected in parallel.

7. An image forming apparatus, comprising:

a photosensitive member unit comprising: a photosensitive member on which an electrostatic image is to be formed; a resistor configured and positioned to generate heat so as to heat the photosensitive member by energization; and a plurality of contact portions, including a first contact portion and a second contact portion which are connected to both ends of the resistor and including a third contact portion connected so as to divide the resistor into two branches; and a voltage supplying mechanism configured and positioned to be selectively connectable to the plurality of contact portions and to be adapted to different commercial power source voltages, wherein the plurality of contact portions are configured and positioned to be selectively connectable to the voltage supplying mechanism, wherein when a first commercial power source voltage is input into said voltage supplying mechanism, said voltage supplying mechanism is configured and positioned to be connected to the first contact portion and the second contact portion, and wherein when a second commercial power source voltage different from the first commercial power source voltage is input into said voltage supplying mechanism, said voltage supplying mechanism is configured and positioned to be connected to the third contact portion and at least one of the first contact portion and the second contact portion so that electric energy consumption of the resistor is substantially equal to that at the time when the first commercial power source voltage is input.

8. An apparatus according to claim 7, wherein said voltage supplying mechanism includes a first voltage supplying portion, a second voltage supplying portion and a third voltage supplying portion which are configured and positioned to supply mutually different commercial power source voltages, wherein when the first commercial power source voltage is input into said voltage supplying mechanism, the first voltage supplying portion and the second voltage supplying portion are configured and positioned to be connected to the first contact portion and the second contact portion so that the resistor is connected in series, and wherein when the second commercial power source voltage is input into said voltage supplying mechanism, the third voltage supplying portion, the first voltage supplying portion and the second voltage supplying portion are configured and positioned to be connected to the third contact portion and at least one of the first contact portion and the second contact portion so that the resistor is connected in parallel.

* * * * *